US012667929B2

(12) United States Patent
Palaver et al.

(10) Patent No.: US 12,667,929 B2
(45) Date of Patent: Jun. 30, 2026

(54) SAFETY OPERATING DEVICE AND MACHINE TOOL SYSTEM COMPRISING SAID SAFETY OPERATING DEVICE

(71) Applicant: Robert Bosch GmbH, Stuttgart (DE)

(72) Inventors: Thomas Palaver, Filderstadt (DE); Christian Koepf, Filderstadt (DE); Peter Molnar, Miskolc (HU); Csaba Kiss, Arnot (HU); Gabriela Eurskens-Merz, Wolfschlugen (DE); Szabolcs Gyori, Szeged (HU); Martin Hirschle, Duernau (DE); Laszlo Gergely, Felsoezsolca (HU)

(73) Assignee: Robert Bosch GmbH, Stuttgart (DE)

( * ) Notice: Subject to any disclaimer, the term of this patent is extended or adjusted under 35 U.S.C. 154(b) by 725 days.

(21) Appl. No.: 18/040,375

(22) PCT Filed: Jul. 26, 2021

(86) PCT No.: PCT/EP2021/070777

§ 371 (c)(1),
(2) Date: Feb. 2, 2023

(87) PCT Pub. No.: WO2022/028930

PCT Pub. Date: Feb. 10, 2022

(65) Prior Publication Data

US 2023/0286104 A1 Sep. 14, 2023

(30) Foreign Application Priority Data

Aug. 5, 2020 (DE) ..... 10 2020 209 908.1

(51) Int. Cl.
*B24B 23/02* (2006.01)

(52) U.S. Cl.
CPC ..... *B24B 23/028* (2013.01)

(58) Field of Classification Search
CPC ..... B24B 23/028; H01H 3/20; H01H 9/06; H01H 21/10; B25F 5/00
See application file for complete search history.

(56) References Cited

U.S. PATENT DOCUMENTS 9,330,858 B2 5/2016 Boeck et al.
11,040,439 B2 * 6/2021 Walker ..... B25F 5/008
(Continued)

FOREIGN PATENT DOCUMENTS

CN 102975179 A 3/2013
CN 106457547 A 2/2017
(Continued)

OTHER PUBLICATIONS

International Search Report corresponding to PCT Application No. PCT/EP2021/070777, mailed Nov. 8, 2021 (German and English language document) (6 pages).
(Continued)

*Primary Examiner* — Edwin A. Leon
(74) *Attorney, Agent, or Firm* — Maginot, Moore & Beck LLP

(57) ABSTRACT

A safety operating device for operating a machine tool in particular a hand-held machine tool includes at least one operating unit, in particular a dead-man unit, for actuating the machine tool. The operating unit is designed to be moved in a sequence of at least two mutually different actuating movements. The device further includes a pre-activation unit that is designed to enable activation of the machine tool by way of an actuation by the operating unit.

13 Claims, 7 Drawing Sheets

(56) References Cited

U.S. PATENT DOCUMENTS

| | | | | |
|---|---|---|---|---|
| 2006/0276114 | A1* | 12/2006 | Gallagher | B24B 55/102 451/344 |
| 2014/0069756 | A1* | 3/2014 | Esenwein | B24B 23/028 188/323 |
| 2014/0190713 | A1 | 7/2014 | Martinsson et al. | |

FOREIGN PATENT DOCUMENTS

| | | | |
|---|---|---|---|
| CN | 206137988 | U | 5/2017 |
| CN | 108567372 | A | 9/2018 |
| DE | 20 2008 002 672 | U1 | 11/2008 |
| DE | 10 2009 027 871 | A1 | 1/2011 |
| DE | 10 2011 089 717 | A1 | 6/2013 |
| DE | 10 2011 089 726 | A1 | 6/2013 |
| DE | 11 2017 003 131 | T5 | 2/2019 |
| WO | 2015/169350 | A1 | 11/2015 |
| WO | 2019/061084 | A1 | 4/2019 |
| WO | 2019/197123 | A1 | 10/2019 |

OTHER PUBLICATIONS

"Electric motor-operated hand-held tools, transportable tools and lawn and garden machinery—Safety—Part 2-3: Particular requirements for hand-held grinders, disc-type polishers and disc-type sanders." IEC 62841-2-3 Edition 1.0, Apr. 2020, International Electrotechnical Commission, Geneva (144 Pages).

* cited by examiner

SAFETY OPERATING DEVICE AND MACHINE TOOL SYSTEM COMPRISING SAID SAFETY OPERATING DEVICE

This application is a 35 U.S.C. § 371 National Stage Application of PCT/EP2021/070777, filed on Jul. 26, 2021, which claims the benefit of priority to Serial No. DE 10 2020 209 908.1, filed on Aug. 5, 2020 in Germany, the disclosures of which are incorporated herein by reference in their entirety.

BACKGROUND

A safety operating device has already been proposed for operating a machine tool, in particular a hand-held machine tool, comprising at least one operating unit, in particular a dead-man unit, for actuating the machine tool, said operating unit being designed to be moved in a sequence of at least two different actuating movements.

SUMMARY

The disclosure proceeds from a safety operating device for operating a machine tool, in particular a hand-held machine tool, comprising at least one operating unit, in particular a dead-man unit, for actuating the machine tool, said operating unit being designed to be moved in a sequence of at least two different actuating movements.

It is proposed for the safety operating device to have a pre-activation unit which is designed to enable activation of the machine tool by means of an actuation by the operating unit.

The machine tool is in particular designed as a hand-held machine tool, preferably as a hand-held power tool. In particular, the machine tool is designed as an angle grinder. The safety operating device is provided in particular for use in a hand-held machine tool. The safety operating device is preferably arranged at least partially on a housing unit of the hand-held machine tool. In particular, the safety operating device can be arranged on a handle of a hand-held machine tool. The operating unit is preferably arranged on the housing unit of the hand-held machine tool. The operating unit is in particular designed as a dead-man device, in particular preferably as a two-way dead-man device. The operating unit is provided in particular for permanent actuation during operation. When there is no actuation, the operating unit preferably goes into an initial position, in particular into a deactivation position. The at least two different actuating movements can in particular be formed by different types of movement, for example a translational movement and a rotational movement, and/or can have different orientations. The directions of the actuating movements can in particular extend transversely to one another. The actuating movements can in particular be carried out by an operator of the machine tool. The pre-activation unit is arranged spatially next to the operating unit, in particular on the housing unit of the hand-held machine tool, in particular at a distance, such that the pre-activation unit and the operating unit can be reached with one hand, preferably with one finger. Preferably, the pre-activation unit is provided to at least temporarily set the safety operating device into a pre-activation state, in particular a standby state, in which the machine tool can be activated by means of an actuation by the operating unit. The fact that the pre-activation unit "is provided to enable an activation of the machine tool by means of an actuation by the operating unit" is to be understood in particular as meaning that an activation of the machine tool by the operating unit is possible in particular only in a pre-activation state triggered by the pre-activation unit. In particular, at least one actuating movement of the operating unit is possible in all operating states of the safety operating device, whereby in particular at least one actuating movement executed in a deactivation state of the safety operating device does not trigger any activation of the machine tool. A deactivation state of the safety operating device is to be understood in particular to mean that the pre-activation unit of the safety operating device is in an unactuated state, and activation of the machine tool is prevented. Deactivation of the machine tool is possible in particular by actuating the pre-activation unit again. The safety operating device comprises in particular a display unit. The display unit is in particular designed as a user interface. The display unit comprises in particular at least one luminous element. The luminous element is in particular designed as an LED. The display unit is in particular provided to indicate a status of the pre-activation unit and/or the operating unit and/or a fault message and/or a charge state to an operator. The display unit is in particular provided to indicate a pre-activation state. Preferably, the display unit flashes when the pre-activation unit is actuated. Preferably, the display unit lights up in a pre-activation state. Particularly preferably, the display unit is inactive in a deactivation state of the machine tool.

The embodiment of the safety operating device according to the disclosure can ensure safe operation of a hand-held machine tool. Furthermore, undesired actuation of the hand-held machine tool can be avoided.

Furthermore, a control unit is proposed which has at least one signal element, the pre-activation unit having at least one pre-activation element which is provided for initiating a pre-activation state for an effective connection to the signal element. A "control unit" is to be understood in particular as a unit comprising a processor unit and comprising a memory unit, and comprising an operating program stored in the memory unit. The control unit can in particular be designed as a processor, in particular as a microcontroller, or as another control unit which appears expedient to a person skilled in the art. The signal element can in particular be designed as a microswitch or the like. The signal element is provided to generate a pre-activation signal upon contact with the pre-activation element. The signal element forwards in particular a pre-activation signal to the control unit. A "pre-activation signal" is to be understood as an electrical signal generated by the pre-activation element due to an electrical contact of the signal element. The pre-activation element is in particular designed as a pusher element, as a slide element, as a tilting element, as a sensor element, or as another pre-activation element which appears expedient to a person skilled in the art. The pre-activation signal preferably sets the safety operating device into a pre-activation state. In principle, an embodiment of the pre-activation element as a touchpad or the like would also be conceivable, with the signal element in this case in particular being at least partially integrated into the pre-activation unit. The control unit is in particular connected to the display unit. In this way, an advantageous pre-activation and/or lock function can be provided. Advantageously, an unplanned activation of a machine tool can thereby also be avoided.

Furthermore, a control unit is proposed, which has at least one further signal element, the operating unit having an operating element which is provided for an effective connection to the further signal element at the end of a last actuating movement of the operating unit. The operating element has in particular an actuating element which is provided in particular to actuate the further signal element. The further signal element is in particular designed as a microswitch or the like. The further signal element generates in particular an operating signal. An "operating signal" is to be understood as an electrical input signal that is generated by an electrical contact of the further signal element with the actuating element of the operating unit. The one signal switching element is in particular formed separately from the further signal element. However, it would also be conceivable for the one signal element and the further signal element to be designed as a signal element which forwards two separate contact points and two independent signals. The operating element is rotatably mounted, in particular about an axis of rotation. Preferably, the operating element is mounted so as to be movable in translation, radially with respect to the axis of rotation. In principle, an embodiment of the operating element as a touchpad or the like would also be conceivable. As a result, a machine tool that is safe for the user can advantageously be provided.

Furthermore, it is proposed for a first actuating movement of the operating element to comprise an at least partially rotational movement about an axis of rotation, and for a second actuating movement of the operating element to comprise a translational movement radially with respect to the axis of rotation, the second actuating movement being provided, in a pre-activation state, to activate the machine tool. The safety operating device preferably has a link unit for guiding the operating element. The link unit is at least partially arranged on a housing unit of the machine tool. The operating element is arranged at least partially within the link unit. The link unit is in particular provided to guide the operating element in the at least partial rotational movement about an axis of rotation. Furthermore, the link unit is provided in particular to enable the translational second actuating movement of the operating element, radially with respect to the axis of rotation. The operating unit has a receiving element which is fixedly arranged, relative to a housing unit, on the housing unit. The receiving element has a recess which is provided in particular to at least partially receive the operating element. The operating element is mounted movably in the receiving unit, in particular by a fastening element. The fastening element is in particular designed as a pin or the like. A longitudinal axis of the fastening element is in particular the axis of rotation of the operating unit. The first actuating movement takes place in particular from an initial position of the operating unit. The first actuating movement has in particular an end position. The end position is defined in particular by a stop of the operating element on the housing unit. A second actuating movement in particular takes place from an end position of the first actuating movement. The operating element is rotatably mounted in particular about the axis of rotation. Preferably, the operating element is mounted so as to be movable in translation, radially with respect to the axis of rotation. In particular, operation of the hand-held machine tool that is safe for the user can thereby advantageously be provided.

It is further proposed for the operating unit to have a spring element which is provided to bring the operating unit into an initial position. The spring element is in particular designed as a helical compression spring or the like. Preferably, the spring element is arranged around an operating element of the operating unit. In particular, the spring element is arranged on the operating unit in a form-fitting, force-fitting and/or integrally bonded manner. The connection of the spring element to the operating unit is provided to build up a restoring force of the spring element relative to the receiving element when the operating element is actuated. The spring element is provided to return the operating element to the initial position by means of a radial restoring force and a translational restoring force. In particular, the spring element is slightly bent in an initial position of the operating unit. As a result, an existing restoring force can advantageously be achieved in the initial position of the operating unit, and a suitable resistance for operating the operating element can thus be provided. In particular, this makes it possible to dispense with further spring elements which, for example, are intended to return the operating element to an initial position in a translational manner. As a result, an advantageously compact design can be achieved.

Furthermore, a guide unit is proposed which is provided to prevent a second actuating movement of the operating unit during a first actuating movement of the operating unit, and to enable the second actuating movement of the operating unit at the end of a first actuating movement of the operating unit. The fact that the guide unit prevents a second actuating movement of the operating unit during a first actuating movement of the operating unit is to be understood in particular to mean that the guide unit engages at least partially under an operating element of the operating unit, so that in particular a pushing movement in the region of the guide unit is prevented. The second actuating movement of the operating unit at the end of a first actuating movement of the operating unit is made possible in particular by the guide unit being limited, in particular up to approximately substantially half of a link unit of the safety operating device. In particular, the guide unit limits a housing recess of the machine tool at least in part. The housing recess is provided for receiving an operating element of the operating unit. In particular, the guide unit has a contour which is at least substantially U-shaped from an operator view, and in particular the opening of the U-shape describes an interface of an initial position of the operating element and an end position of the first actuating movement of the operating element. As a result, the standard requirements for angle grinders IEC FDIS 62841-2-3 IEC 2020 can be met, and therefore a hand-held machine tool that is safe for a user can be achieved.

Furthermore, at least one blocking unit is proposed, which is arranged at least partially on the guide unit and is provided, during a first actuating movement, to block an advance into an end position of the first actuating movement in the event of a force influence on the operating unit which is directed radially with respect to an axis of rotation of the operating unit. The blocking unit can preferably block the at least one actuating movement by means of friction which arises in particular in the case of a force influence on the operating unit which is directed radially with respect to an axis of rotation of the operating unit. Particularly preferably, the blocking unit is designed as a mechanical resistance, in particular as a material elevation and/or a stop. The blocking is intended to take place in particular by a form-fitting connection between an operating element of the operating unit and the blocking unit. The operating element of the operating unit has, in particular, a chamfer which is provided for entering the form-fitting connection with the blocking unit. The blocking unit is arranged on the guide unit in particular at an interface of an initial position of an operating element and an end position of a first actuating movement. The blocking unit is in particular designed as a lifting extension or the like. The guide unit in particular describes a guide surface which is translational relative to an axis of rotation of the operating unit, in particular congruent with a movement path of an operating element. The blocking unit is in particular located in the one guide surface and is provided to block a movement along the one guide surface. The blocking unit describes a further guide surface which is in particular congruent with the one guide surface. The further guide surface is in particular located on the blocking unit. The two guide surfaces describe in particular a radial clearance. The first actuating movement of the operating unit takes place in particular by a force influence on an operating element of the operating unit which is directed at least substantially translationally with respect to an axis of rotation of the operating unit. The first actuating movement of the operating unit takes place in particular along and/or on the further guide surface. In the case of a force influence on the operating element of the operating unit which is directed radially with respect to an axis of rotation of the operating unit, during a first actuating movement, the operating element is displaced in the radial clearance onto the one guide surface. Preferably, the first actuating movement is blocked on the one guide surface by the blocking unit. Advantageously, a child lock and/or a machine tool that is safe for a user can thereby be provided.

Furthermore, it is proposed that the control unit is provided to end a pre-activation state of the pre-activation unit after a defined period of time when the operating unit is inactive, and to prevent activation of the machine tool by the operating unit. Preferably, the defined period of time is defined for a duration of at least 20 seconds, preferably of at least 25 seconds, and preferably of at most 60 seconds, particularly preferably of at most 30 seconds. In particular, in a pre-activation state, the pre-activation state can be deactivated by actuating the pre-activation unit again and the safety operating device can be set into a deactivation state. In particular, further pre-activation by the pre-activation unit is necessary. In this way, operation of a machine tool that is safe for a user can advantageously be provided.

Furthermore, the disclosure proceeds from a machine tool system comprising at least one machine tool, in particular an angle grinder, comprising a machine tool accessory, in particular a grinding wheel, and comprising at least one safety operating device according to the disclosure. Preferably, the machine tool can be operated using electrical energy. Preferably, the machine tool comprises further components, in particular required for operation of the machine tool. In particular, the machine tool can comprise at least one power supply unit, for example an accumulator, a power cable or the like, a housing and/or further components that appear expedient to a person skilled in the art. The machine tool is preferably designed as an angle grinder. The machine tool is provided for an effective connection to a machine tool accessory. The machine tool accessory can be designed in particular as a grinding wheel, as a carbide disk, as a cutting disk, as a protective device, in particular having a ratchet, or the like. Furthermore, the machine tool accessory has in particular an outer diameter of less than or equal to 50 mm. In particular, the machine tool accessory preferably has a fastening recess having a diameter of in particular less than 15 mm, preferably of exactly 12 mm. The protective device is in particular designed to be exchangeable and/or adjustable by a ratchet, and preferably is designed as a grinding and/or cutting guard, in particular having a dust suction system, as a protective device, in particular having a depth stop or a hands-free cutting guard. In particular, the machine tool accessory is preferably provided to be fastened to the machine tool by means of a screw or the like. Alternatively, it is conceivable that the machine tool is designed as a jigsaw, as a drill or as another machine tool that appears expedient to a person skilled in the art. A compact machine tool that is safe for a user can advantageously be provided.

Furthermore, it is proposed that the machine tool has a drive unit, the operating unit, upon actuation, being provided to activate the drive unit depending on a switching state of the pre-activation unit. Preferably, the drive unit, in particular at least one electric motor of the drive unit, of the machine tool is controlled, in particular activated, by the control unit depending on an evaluation of the position characteristic variables of the pre-activation unit and the operating unit. Preferably, a signal unit provides the position characteristic variables of a signal element in the form of an electrical or electronic signal. The machine tool preferably has an energy storage unit. The energy storage unit can be designed as a rechargeable battery or the like. The energy storage unit is preferably effectively connected to the pre-activation unit. The machine tool preferably has a supply unit which is provided in particular to supply different components of the machine tool with energy from the energy storage unit. The machine tool preferably has a charging unit which is effectively connected to the energy storage unit, in particular for an integrated charging control. In particular, the energy storage unit supplies power to the supply unit and/or to the charging unit. In particular, the supply unit supplies power to the control unit and/or to the display unit. The pre-activation unit triggers a pre-activation signal, in particular upon actuation, which is forwarded at least to the control unit. The control unit forwards in particular the pre-activation signal to the display unit. Upon actuation, the operating unit triggers an operating signal which is also forwarded to the control unit. The operating signal is in particular provided for an on or off function. The machine tool has at least one driver unit, which is provided in particular to control an interaction between different components, in particular between the control unit and, for example, the drive unit. The machine tool has in particular a power stage unit which is preferably provided for battery separation, in particular between the energy storage unit and the drive unit. The power stage unit in particular has at least one transistor element. The transistor element is in particular designed as a metal-oxide-semiconductor field-effect transistor (MOSFET) which has in particular at least one gate. The gate of the one transistor element is preferably in a closed state when the machine tool is pre-activated by means of the pre-activation unit, and the operating unit triggers an operating signal at the end of the second actuating movement of the operating element. In an open state, the gate is provided to interrupt the energy supply from the energy storage unit to the drive unit of the machine tool, preferably at a positive pole. A further gate of a further transistor element is provided in an open state to interrupt the energy supply from the energy storage unit to the drive unit of the machine tool at a negative pole. In the initial position of the operating unit, in particular all poles from the energy storage unit to the drive unit are interrupted. The safety operating device has in particular at least one sensor unit which is provided to detect characteristic variables of the machine tool and/or of the machine tool system and to preferably forward them to the control unit. The characteristic variables can in particular describe a voltage, a current strength and/or a temperature or the like. The control unit has, in particular, software functions which, for example, keep a soft start, a braking function, a speed limit and a speed range constant, and/or can include a data readout or the like. The machine tool has a direct voltage intermediate circuit, which is provided in particular to electrically couple a plurality of electrical networks, as an energy store, on an interposed current or voltage level. As a result, a complex hand-held machine tool can advantageously be provided in a functionally reliable manner.

In this case, the safety operating device according to the disclosure is not intended to be limited to the application and embodiment described above. In particular, in order to fulfill a mode of operation described herein, the safety operating device according to the disclosure can include a number of individual elements, components and units that deviates from a number mentioned herein. In addition, in the case of the value ranges specified in this disclosure, values within the mentioned limits are also to be considered as disclosed and usable as desired.

BRIEF DESCRIPTION OF THE DRAWINGS

Further advantages result from the following description of the drawings. An embodiment of the disclosure is illustrated in the drawings. The drawings, the description and the claims contain numerous features in combination. A person skilled in the art will expediently also consider the features individually and combine them to form meaningful further combinations. In the drawings:

DETAILED DESCRIPTION

Figure 1:
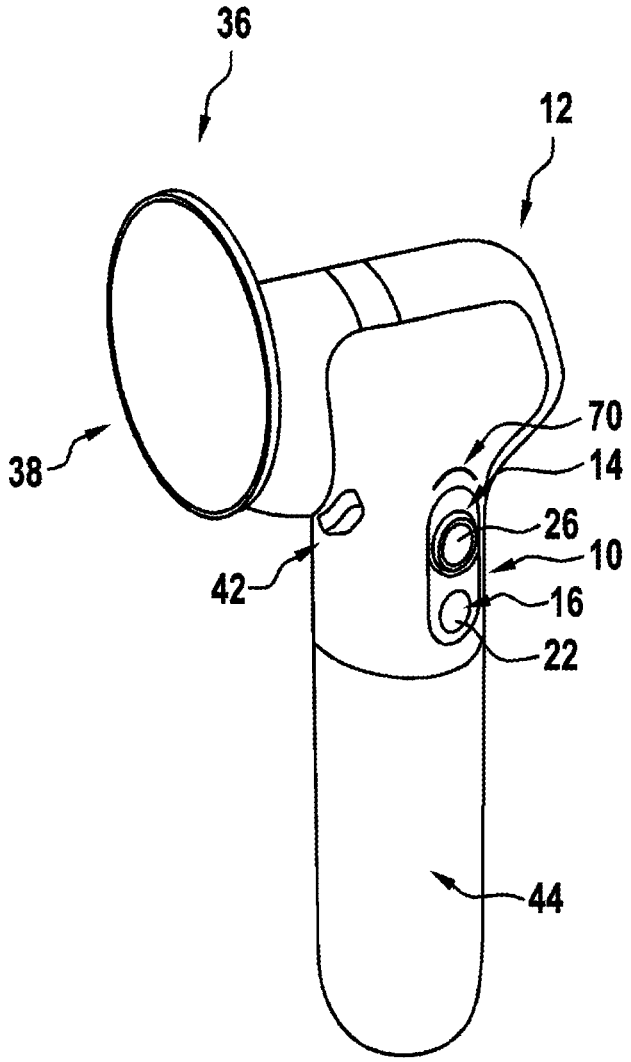
FIG. 1 is a schematic view of a machine tool comprising a safety operating device according to the disclosure.

FIG. 1 is a schematic view of a machine tool system 36 comprising a machine tool 12 and a machine tool accessory 38, and comprising a safety operating device 10 according to the disclosure. The machine tool 12 is in particular designed as an angle grinder. The machine tool system 36 is provided for accommodating the machine tool accessory 38. The machine tool accessory 38 is designed as a grinding wheel. The machine tool accessory 38 can also be designed as a cutting disk or the like. The machine tool system 36 has a spindle lock 42. The machine tool system 36 has a housing unit 44. The safety operating device 10 has an operating unit 14. The operating unit 14 is designed as a dead-man device. The operating unit 14 is designed as a two-way dead-man device. The operating unit 14 has an operating element 26. The safety operating device 10 has a pre-activation unit 16. The pre-activation unit 16 has a pre-activation element 22. The operating unit 14 is provided to activate the machine tool 12 by means of at least two actuating movements of the operating element 26 by an operator, depending on a pre-activation state of the pre-activation unit 16. The safety operating device 10 has a display unit 70.

Figure 2:
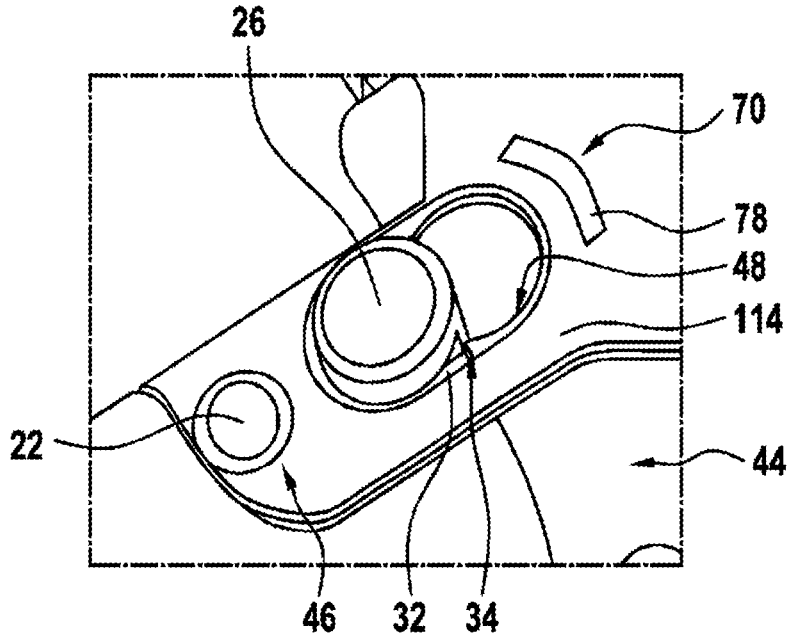
FIG. 2 is a schematic view of the safety operating device according to the disclosure, in a plan view of a housing of the machine tool in a deactivation state.

FIG. 2 shows the pre-activation element 22 and the operating element 26 from an operator view in an initial position. The machine tool 12 is in a deactivation state. The display unit 70 has a luminous element 78. The luminous element 78 is designed as an LED. The luminous element 78 is provided to indicate the status of the pre-activation unit 16, and/or an error warning, and/or a state of charge of the machine tool 12 to an operator. The display unit 70 is inactive in a deactivation state. The pre-activation element 22 is arranged at least in part on the housing unit 44. The operating element 26 is arranged at least in part on the housing unit 44. The housing unit 44 has at least one housing recess 46, 48. The safety operating device 10 is arranged at least in part so as to be accessible to an operator through the at least one housing recess 46, 48 on the housing unit 44. The safety operating device 10 has a link unit 114. The link unit 114 is arranged on the further housing recess 48. The link unit 114 delimits the further housing recess 48. The pre-activation element 22 is arranged in the housing recess 46 of the housing unit 44. The housing unit 44 delimits the housing recess 46. The housing recess 46 has a circular contour. The housing unit 44 is provided, by means of the housing recess 46, to enable an axial actuating movement of the pre-activation element 22. The housing unit 44 has a further housing recess 48. The operating element 26 is arranged at least in part in the further housing recess 48. The link unit 114 delimits the further housing recess 48. The further housing recess 48 has a slot-like contour. The link unit 114 is provided, by means of the further housing recess 48, to enable a rotational actuating movement about an axis of rotation of the operating unit 14. The safety operating device 10 has a guide unit 32. The guide unit 32 is provided to enable a first actuating movement of the operating element 26. The guide unit 32 is provided to prevent a second actuating movement of the operating element 26 in an initial position of the operating element 26. The guide unit 32 is arranged on the link unit 114. The guide unit 32 is arranged within the further housing recess 48 on the link unit 114. The guide unit 32 is arranged on a side of the further housing recess 48 facing the pre-activation unit 16, in a U-shape on the housing unit 44. The side of the further housing recess 48 facing away from the pre-activation unit 16 is free of the guide unit 32. The safety operating device 10 has a blocking unit 34. The blocking unit 34 is designed as a lifting extension. The blocking unit 34 is arranged at least in part on the guide unit 32. The blocking unit 34 is provided to block a first actuating movement of the operating element 26 in the event of a force influence on the operating element 26 which is directed radially with respect to the axis of rotation of the operating unit 14.

Figure 3:
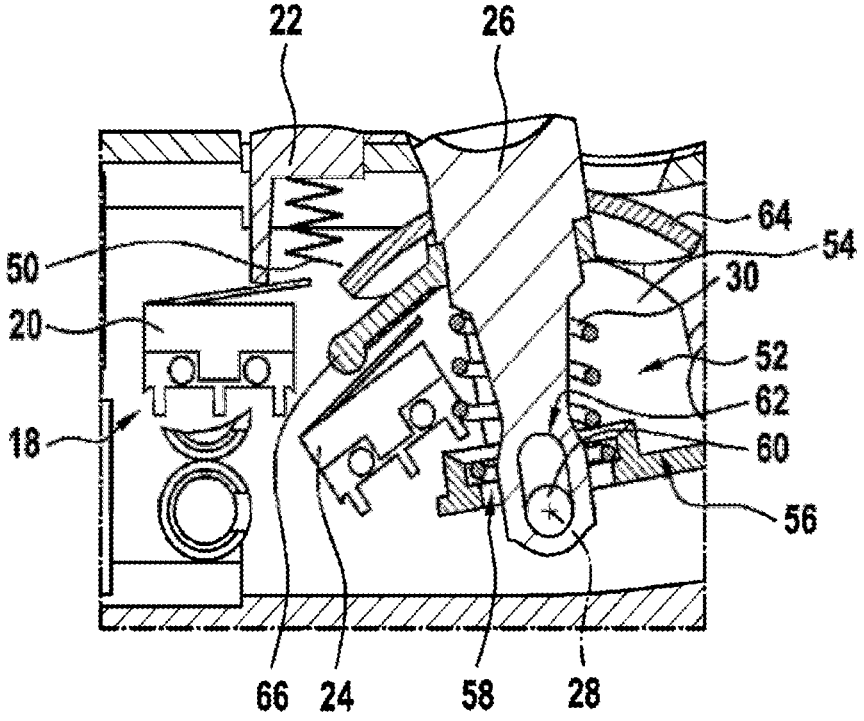
FIG. 3 is a schematic sectional view of the safety operating device according to the disclosure in a deactivation state.

FIG. 3 is a sectional view in a longitudinal section of the safety operating device 10 shown in FIG. 2. The pre-activation unit 16 has a restoring element 50 which is arranged on the pre-activation element 22. The restoring element 50 is provided to return the pre-activation element 22 to an initial position after actuation. The safety operating device 10 has a control unit 18. The control unit 18 has at least one signal element 20, 24. One signal element 20 is provided for an effective connection to the pre-activation unit 16. A further signal element 24 is provided for an effective connection to the operating unit 14. The signal element 20 is arranged in close proximity to the pre-activation unit 16 within the safety operating device 10. The further signal element 24 is arranged in close proximity to the operating unit 14 within the safety operating device 10. The signal element 20 and the further signal element 24 are designed as microswitches. The signal element 20 is provided for forwarding an actuation of the pre-activation unit 16, as an electrical signal, to the control unit 18. The further signal element 24 is provided for forwarding an actuation of the operating unit 14 to the control unit 18 after contact has been made with the further signal element 24.

The operating unit 14 has a receiving element 52. The receiving element 52 is provided to fasten the operating element 26 movably relative to the housing unit 44 of the machine tool 12. The receiving element 52 has at least two receiving surfaces 54, 56, which are at least substantially transverse to one another. A receiving surface 54 lying at least substantially in parallel with a longitudinal axis of the operating element 26 is provided to fasten the operating unit 14 to the housing unit 44. A further receiving surface 56, which is at least substantially transverse to a longitudinal axis of the operating element 26, has a recess 58. The operating element 26 is arranged at least in part within the recess 58. The operating unit 14 has a spring element 30, which is provided to return the operating element 26 to an initial position. The spring element 30 is arranged around the operating element 26. The operating element 26 is arranged coaxially with respect to the spring element 30. The spring element 30 is arranged on the further receiving surface 56 lying at least substantially transversely to a longitudinal axis of the operating element 26.

The operating element 14 has a fastening element 60. The fastening element 60 is designed as a pin. The further receiving surface 56 is provided for at least partially receiving the fastening element 60. The operating element 26 has a slot recess 62. The fastening element 60 engages in the slot recess 62 of the operating element 26. The operating element 26 is provided, by means of the slot recess 62, for an axial actuating movement. In the axial actuating movement, the spring element 30 is compressed and a restoring force arises. By means of the restoring force of the spring element 30, the operating element can be returned to an initial position, which is shown in FIG. 3. The operating unit 14 has a cover element 64 which is provided to cover the further housing recess 48 of the housing unit 44 in which the operating element 26 is arranged. The cover element 64 has a curvature. The cover element 64 is arranged on the operating element 26. The operating unit 14 has an actuating element 66. The actuating element 66 is arranged on the operating element 26. The actuating element 66 is arranged on the operating element 26, below a side of the cover element 64 facing the axis of rotation 28. The actuating element 66 is provided to actuate the further signal element 24 of the control unit 18 during an axial actuating movement of the operating element 26.

Figure 4:
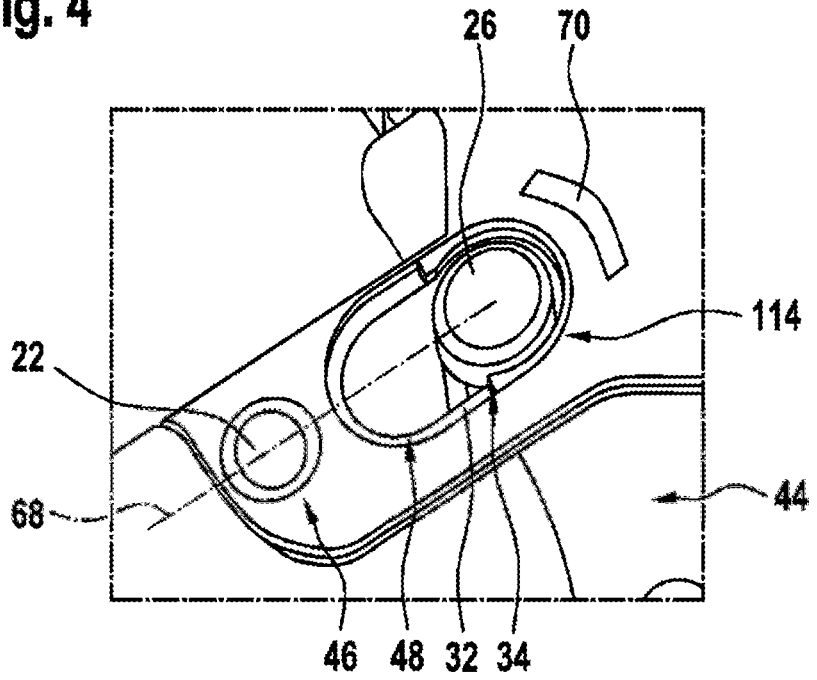
FIG. 4 is a schematic view of the safety operating device according to the disclosure, in a plan view of a housing of the machine tool at the end of a second actuating movement.

FIG. 4 shows the operating unit 14 after two completed actuating movements. A first actuating movement is a rotational movement about the axis of rotation of the operating element 26. The first actuating movement takes place by means of a force influence which is directed translationally with respect to the axis of rotation of the operating unit 14 and is directed at least substantially in parallel with a housing longitudinal axis 68 of the housing unit 44. The further housing recess 48, which receives the operating element 26, is delimited by the link unit 114. The link unit 114 is provided to form a stop for the operating element 26 at the end of the first actuating movement. If the operating element 26 is at the end of the first actuating movement, a second actuating movement can take place. The second actuating movement takes place by means of a force influence which is directed radially with respect to the axis of rotation of the operating unit 14 and which is at least substantially axial relative to the operating element 26.

Figure 5:
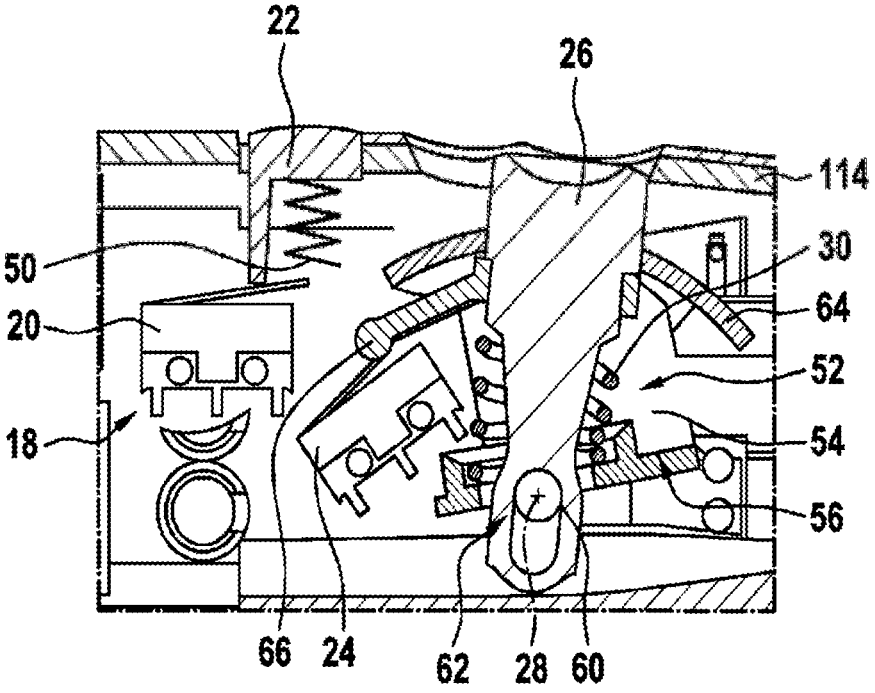
FIG. 5 is a schematic sectional view of the safety operating device according to the disclosure at the end of a second actuating movement.

FIG. 5 is a sectional view of the safety operating device 10 according to the disclosure in the illustrated state of FIG. 4. At the end of the second actuating movement, the operating element 26 is axially displaced in the slot recess 62 by means of the fastening element 60. The spring element 30 is compressed at the end of the second actuating movement. The actuating element 66 of the operating unit 14 is in contact with the further signal element 24. The further signal element 24 is provided for forwarding the contact signal to the control unit 18.

Figure 6:
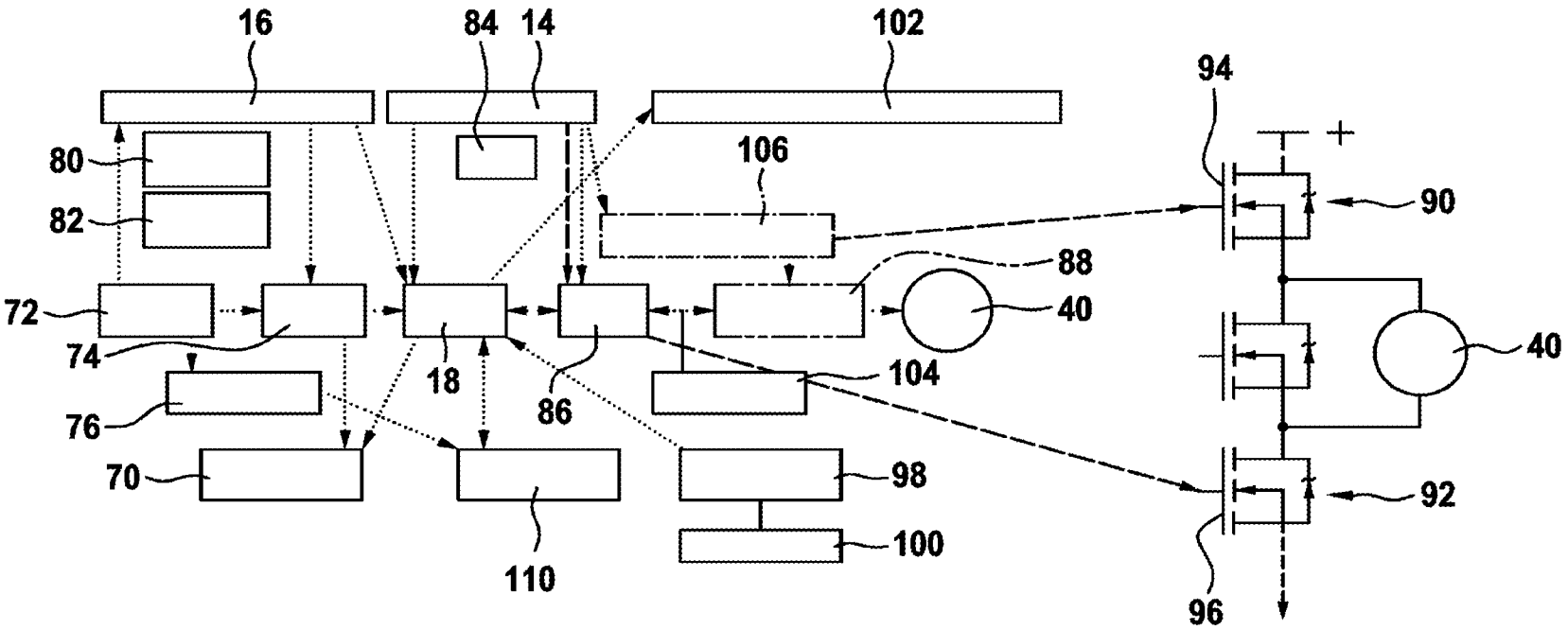
FIG. 6 is a schematic functional block diagram of a machine tool comprising the safety operating device according to the disclosure.

FIG. 6 is a schematic functional block diagram of the machine tool 12 comprising the safety operating device 10 according to the disclosure. The machine tool 12 has an energy storage unit 72. The energy storage unit 72 is designed as a rechargeable battery. The energy storage unit 72 is effectively connected to the pre-activation unit 16. Furthermore, the energy storage unit 72 supplies power to a supply unit 74. The energy storage unit 72 supplies power to a charging unit 76. The supply unit 74 supplies power to the control unit 18. The charging unit 76 controls the power supply to the control unit 18. The charging unit 76 is effectively connected to a charge controller 110. The charge controller 110 is provided for a charging process by means of USB-C PD. The supply unit 74 supplies power to the display unit 70. Upon actuation, the pre-activation unit 16 triggers a pre-activation signal which is forwarded to the supply unit 74. The pre-activation signal is provided for a wake-up function 80 and/or a blocking function 82. The supply unit 74 forwards a pre-activation signal to the display unit 70. The pre-activation signal is further forwarded to the control unit 18. Upon actuation, the operating unit 14 triggers an operating signal which is also forwarded to the control unit 18. The operating signal is provided for an on or off function 84. If a pre-activation signal and an operating signal have been received in the control unit 18, the control unit 18 initiates a driver unit 86. The driver unit 86 is effectively connected to a power stage unit 88.

The power stage unit 88 is provided for a battery separation 106. The power stage unit 88 has at least one transistor element 90, 92. The one transistor element 90 has a gate 94. The further transistor element 92 has a further gate 96. The one gate 94 is controlled by the operating unit 14. The gate 94 is in a closed state when the machine tool 12 is pre-activated by means of the pre-activation unit 16, and the operating unit 14 triggers an operating signal at the end of the second actuating movement of the operating element 26. If the gate 94 is in an open state, the energy supply from the energy storage unit 72 to the drive unit 40 of the machine tool 12 is interrupted at a positive pole. The further gate 96 is in a closed state when a pre-activation signal is received in the control unit 18, when an operating signal is received in the control unit 18, when the control unit 18 forwards the operating signal to the driver unit 86, and when the operating signal is received in the driver unit 86. If the gate 96 is in an open state, the energy supply from the energy storage unit 72 to the drive unit 40 of the machine tool 12 is interrupted at a negative pole.

The safety operating device 10 has at least one sensor unit 98 which is provided to detect characteristic variables 100 of the machine tool 12 and to forward them to the control unit 18. The characteristic variables 100 can describe voltage, current intensity, temperature or the like. The control unit 18 has, in particular, software functions 102 which, for example, keep a soft start, a braking function, a speed limit and a speed range constant, and/or can include a data readout or the like. The machine tool 12 has a direct voltage intermediate circuit 104, which is provided to electrically couple a plurality of electrical networks, as an energy store, on an interposed current or voltage level via converters.

Figure 7:
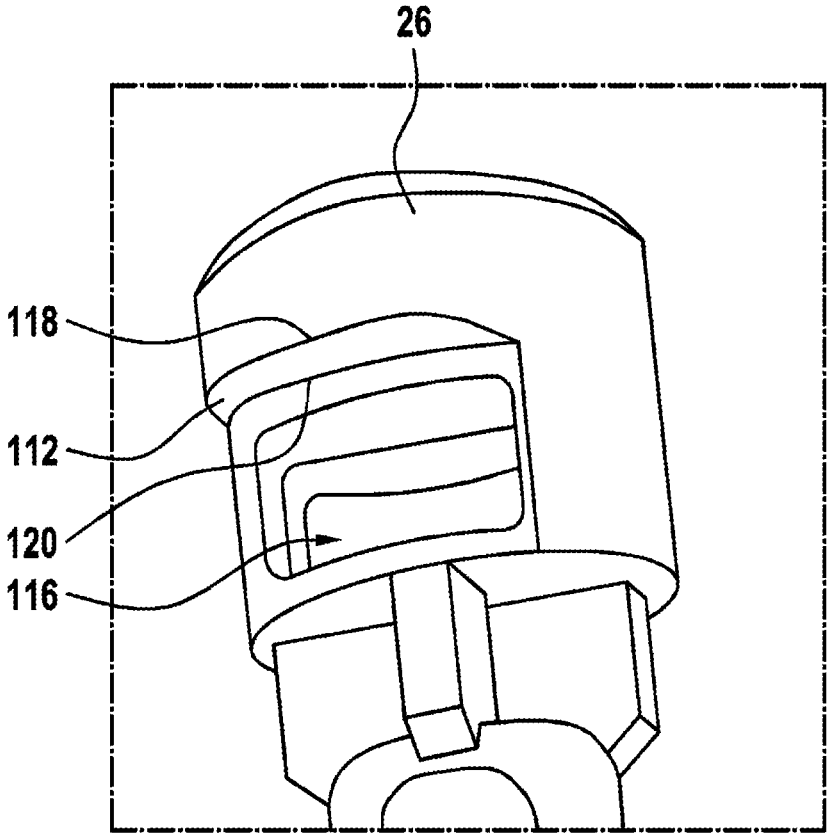
FIG. 7 is a detailed view of an operating element of the safety operating device according to the disclosure.

FIG. 7 is a detailed view of the operating element 26 comprising a chamfer 112. The chamfer 112 is arranged on a side of the operating element 26 facing the guide unit 32. The chamfer 112 forms a blocking edge 118 on the operating element 26. The chamfer 112 forms a guide edge 120 on the operating element 26. The operating element 26 can have a further recess 116.

Figure 8:
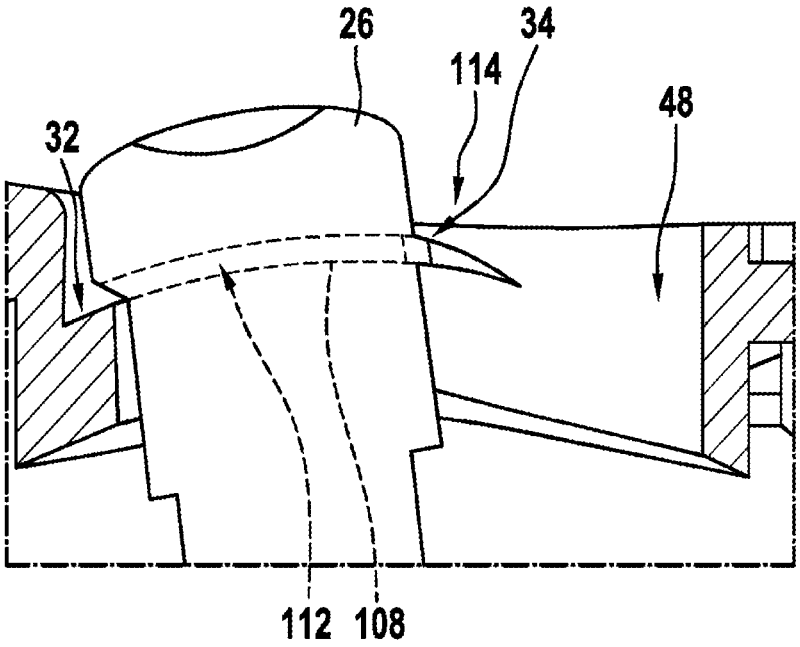
FIG. 8 is a schematic view of the operating element of the safety operating device according to the disclosure in an initial position.

FIG. 8 is a schematic view of a detail of the safety operating device 10. The operating element 26 is arranged in the link unit 114. The guide unit 32 is arranged on the link unit 114. The guide unit 32 has a curvature. The operating element 26 moves along the guide unit 32 during a first actuating movement. The operating element 26 is moved along the guide unit 32 at the guide edge 120 during a first actuating movement. The blocking unit 34 is arranged at least in part on the guide unit 32. The blocking unit 34 is arranged on the guide unit 32 at an interface of the initial position of the operating element 26 and an end position of the first actuating movement. The guide unit 32 has at least one guide surface 108. During the first actuating movement, the operating element 26 is moved on the guide edge 120 of the chamfer 112, in parallel with the guide surface 108 of the guide unit 32. The blocking unit 34 rests on the guide surface 108 and is provided to block a movement of the operating element 26 along the one guide surface 108 with force influence which is directed radially with respect to the axis of rotation 28 and is greater than a spring force of the spring element 30 of the operating unit 14.

Figure 9:
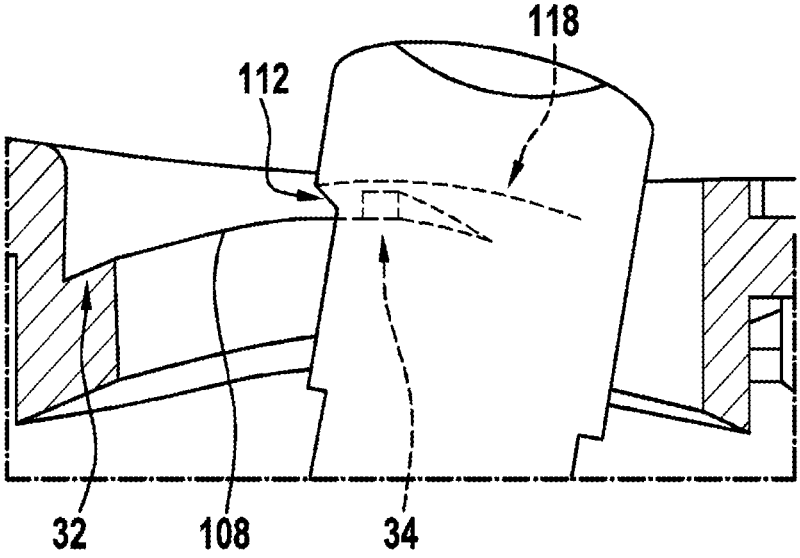
FIG. 9 is a schematic view of the operating element at the end of a first actuating movement.

The first actuating movement of the operating unit 14 takes place in particular by a force influence on the operating element 26 of the operating unit 14 which is directed at least substantially translationally with respect to the axis of rotation of the operating unit 14. The first actuating movement of the operating element 26 with a force influence on the operating element 26 directed purely translationally with respect to the axis of rotation of the operating element 26 takes place along the blocking edge 118, via the blocking unit 34. During a first actuating movement, the operating element 26 is pushed over the blocking unit 34 on the blocking edge 118, as shown in FIG. 9. The chamfer 112 blocks against the blocking unit 34 during the first actuating movement of the operating element 26 when a force influence is directly radially with respect to the axis of rotation of the operating element 26.

Figure 10:
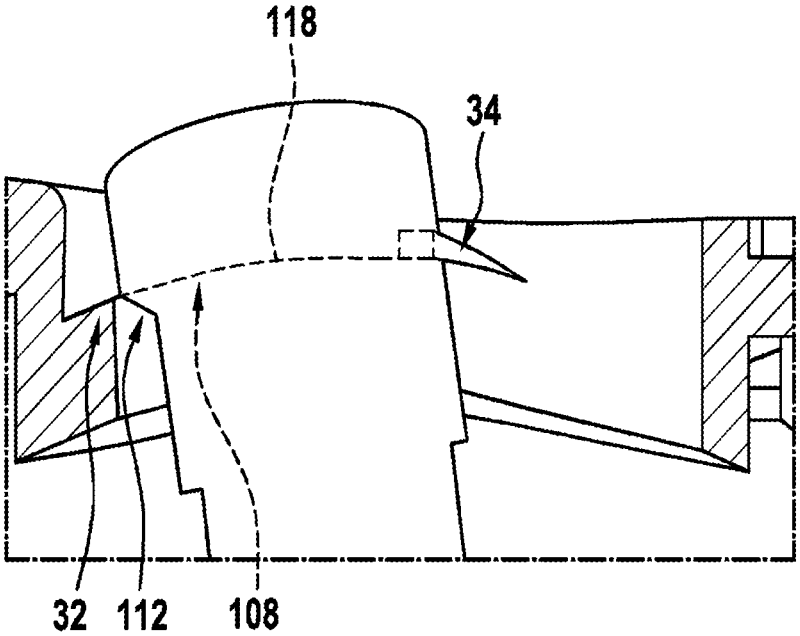
FIG. 10 is a schematic view of the operating element in a blocking state in the case of a force influence directed radially with respect to an axis of rotation of the operating unit.

FIG. 10 shows the operating element 26 in a blocking position due to a force influence on the operating element 26 which is directed radially with respect to the axis of rotation 28 of the operating element 26, during an initiation of the first actuating movement out of the initial position. In the case of a force influence on the operating element 26 of the operating unit 14 which is directed radially with respect to the axis of rotation 28 of the operating element 26, during a first actuating movement the operating element 26 is displaced translationally, so that the blocking edge 118 rests on the guide surface 108. The blocking edge 118 enters a form-fitting connection with the blocking unit 34. The first actuating movement with the blocking edge 118 of the chamfer 112 along the one guide surface 108 is blocked by the blocking unit 34. The chamfer 112 is at least substantially congruent with the guide surface 108. The blocking edge 118 is at least substantially congruent with the guide surface 108.

The invention claimed is:

1. A safety operating device for operating a machine tool, comprising:

an operating unit configured to actuate the machine tool, said operating unit configured and operable to be moved in a sequence of at least two different actuating movements; and a pre-activation unit designed to enable activation of the machine tool by way of an actuation by the operating unit.

2. The safety operating device according to claim 1, further comprising a control unit which has at least one signal element, wherein the pre-activation unit has at least one pre-activation element which is configured to initiate a pre-activation state for an effective connection to the signal element.

3. The safety operating device according to claim 1, further comprising a control unit which has at least one further signal element, wherein the operating unit has an operating element configured for an effective connection to the further signal element at the end of a last actuating movement of the operating unit.

4. The safety operating device according to claim 1, wherein:

a first actuating movement of the operating unit comprises an at least partially rotational movement about an axis of rotation of an operating element, and a second actuating movement of the operating unit comprises a translational movement radially with respect to the axis of rotation, the second actuating movement being effective, in a pre-activation state, to activate the machine tool.

5. The safety operating device according to claim 1, wherein the operating unit has a spring element configured to bring the operating unit into an initial position.

6. The safety operating device according to claim 1, further comprising a guide unit configured to (i) prevent a second actuating movement of the operating unit during a first actuating movement of the operating unit, and (ii) enable the second actuating movement of the operating unit at the end of a first actuating movement of the operating unit.

7. The safety operating device according to claim 6, further comprising at least one blocking unit arranged at least partially on the guide unit, said blocking unit being configured to, during the first actuating movement, block an advance into an end position of the first actuating movement in the event of a force influence on the operating unit which is directed radially with respect to an axis of rotation of the operating unit.

8. The safety operating device according to claim 1, further comprising a control unit configured to (i) end a pre-activation state of the pre-activation unit after a defined period of time when the operating unit is inactive, and (ii) prevent activation of the machine tool by the operating unit.

9. A machine tool system, comprising:

at the least one machine tool including a machine tool accessory, and the safety operating device according to claim 1.

10. The machine tool system according to claim 9, wherein:

the machine tool has a drive unit, and the operating unit is configured to, upon actuation, activate the drive unit in dependence on a switching state of the pre-activation unit.

11. The safety operating device according to claim 1, wherein the machine tool is a hand-held machine tool.

12. The safety operating device according to claim 11, wherein the operating unit is at least one dead man unit.

13. The safety machine tool system according to claim 9, wherein:

the machine tool is an angle grinder, and the machine tool accessory is a grinding wheel.

* * * * *